US006883744B2

(12) United States Patent
Couchey et al.

(10) Patent No.: US 6,883,744 B2
(45) Date of Patent: Apr. 26, 2005

(54) SPOOL FOR OPTICAL FIBER MEDIA

(75) Inventors: Brian P. Couchey, Inman, SC (US); William E. Leidel, Greer, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 10/295,214

(22) Filed: Nov. 15, 2002

(65) Prior Publication Data

US 2003/0146333 A1 Aug. 7, 2003

Related U.S. Application Data

(60) Provisional application No. 60/331,900, filed on Nov. 19, 2001.

(51) Int. Cl.[7] ..... B65H 75/28

(52) U.S. Cl. ..... 242/475.7; 242/125.1; 242/476.1

(58) Field of Search ..... 242/475.7, 125.1, 242/476.1, 920

(56) References Cited

U.S. PATENT DOCUMENTS

| | | | | |
|---|---|---|---|---|
| 218,722 | A | | 8/1879 | Eldridge |
| 1,456,108 | A | | 5/1923 | Johannesen |
| 2,501,596 | A | | 3/1950 | Denny |
| 2,811,322 | A | | 10/1957 | Wilkinson |
| 3,610,549 | A | | 10/1971 | Wennerstrom |
| 3,948,458 | A | | 4/1976 | Beck et al. |
| 4,219,274 | A | | 8/1980 | Dabby et al. |
| 4,387,863 | A | | 6/1983 | Edmonston et al. |
| 4,445,649 | A | | 5/1984 | Yataki et al. |
| 4,602,751 | A | | 7/1986 | Vogel |
| 4,653,331 | A | | 3/1987 | Inouye et al. |
| 4,657,203 | A | | 4/1987 | Crawford |
| 4,696,438 | A | | 9/1987 | Myers |
| 4,715,594 | A | * | 12/1987 | Isobe et al. ..... 271/65 |
| 4,753,399 | A | * | 6/1988 | Baum ..... 242/613.4 |
| 4,781,461 | A | | 11/1988 | Baron et al. |
| 4,793,708 | A | | 12/1988 | Bednarz |
| 4,796,830 | A | | 1/1989 | Gelfman |
| 4,802,270 | A | | 2/1989 | Kashiwaya et al. |
| 4,880,182 | A | | 11/1989 | Gelfman |
| 4,938,432 | A | | 7/1990 | Kurt et al. |
| 5,067,665 | A | | 11/1991 | LoStracco et al. |
| 5,071,082 | A | | 12/1991 | Lefevre et al. |
| 5,100,078 | A | | 3/1992 | Clark |
| 5,165,543 | A | | 11/1992 | Heyda et al. |
| 5,193,761 | A | | 3/1993 | Fritz et al. |
| 5,205,510 | A | | 4/1993 | Schotter |
| 5,220,632 | A | | 6/1993 | LoStracco |
| 5,236,145 | A | | 8/1993 | Floury et al. |
| 5,335,874 | A | | 8/1994 | Shrum et al. |
| 5,379,965 | A | | 1/1995 | Isler et al. |
| 5,593,101 | A | | 1/1997 | Varga |
| 5,718,397 | A | | 2/1998 | Stevens |
| 5,890,674 | A | | 4/1999 | Major |
| 5,895,005 | A | | 4/1999 | Simchock |
| 5,908,172 | A | | 6/1999 | Pierro et al. |
| 5,971,316 | A | | 10/1999 | Kim |
| 6,098,918 | A | | 8/2000 | Simchock |

FOREIGN PATENT DOCUMENTS

| | | |
|---|---|---|
| DE | 29807873 U | 9/1998 |
| JP | 200219433 A | 8/2000 |

* cited by examiner

*Primary Examiner*—Emmanuel Marcelo
*Assistant Examiner*—Evan H Langdon
(74) *Attorney, Agent, or Firm*—Drinker Biddle & Reath LLP

(57) ABSTRACT

A spool for optical fiber ribbon or other flexible media has an opening communicating with an interior of the spool in which a first end of a helical guide is located. The helical guide receives the ribbon from an exterior winding space to direct the ribbon to an auxiliary winding surface located outside one of the main flanges at an end of the spool.

18 Claims, 6 Drawing Sheets

FIG. 4

SPOOL FOR OPTICAL FIBER MEDIA

CROSS-REFERENCE TO RELATED APPLICATION

The present application is related to and claims priority from U.S. Provisional Application Ser. No. 60/331,900, filed Nov. 19, 2001, which is incorporated herein by reference in its entirety.

FIELD OF THE INVENTION

The invention relates to spools for storing and transporting lengths of fibers, ribbons, cables and other elongated flexible materials, especially optical fiber ribbons.

BACKGROUND OF THE INVENTION

It is well known to store and transport lengths of a flexible material wound onto a spool or reel. The spool typically consists of a cylindrical barrel with a flange at each end projecting radially outwards. Examples of prior spools for fiber optic media are described in U.S. Pat. No. 5,908,172 to Pierro et al., issued Jun. 1, 1999, which is incorporated herein by reference in its entirety.

When material is wound on a spool, the inside end portion tends to be close to the barrel and covered by material that is subsequently wound. For certain materials, however, such as for fiber-optic media, access to both ends of the wound material is desirable for integrity testing to ensure that the material is not damage or defective. The inside end portion, therefore, must be led away from the barrel of the spool to a more accessible position.

It is important to avoid damage to either the inside end portion or the main portion of the fiber-optic medium, and to avoid the formation of sharp bends or kinks that might be mistaken for faults when the medium is being tested.

SUMMARY OF THE INVENTION

According to one aspect, the invention provides a device for winding an elongated material. The winding device includes a barrel having an outer surface and defining a longitudinal axis and at least one flange secured to the barrel and having an outer surface. The outer surfaces of the barrel and the flange define an exterior space for winding an elongated material. One of the barrel and the flange defines an interior and an opening. The opening communicates with both the interior and the exterior space for passage of an end portion of the elongated material therebetween.

The winding device further includes a material guide having a first end located within the interior adjacent the opening and an opposite second end. The second end of the material guide located longitudinally outwardly from the flange opposite the exterior space. The material guide defines a pathway for passage of the end portion of the elongated material between the first and second ends, a portion of the pathway being helical.

In another aspect, the invention provides a spool including a barrel having a hollow cylindrical wall defining opposite inner and outer surfaces and a pair of flanges secured to the barrel to define a winding space between the flanges. The wall of the barrel includes an opening communicating with the winding space. The spool further includes an insert having an outer cylindrical surface slidingly received by the inner surface of the barrel wall. The barrel and the insert define a helical guide channel therebetween having opposite first and second ends. The first end of the helical guide channel is located adjacent the opening in the barrel wall.

DETAILED DESCRIPTION OF THE PREFERRED EMBODIMENT

Figure 1:
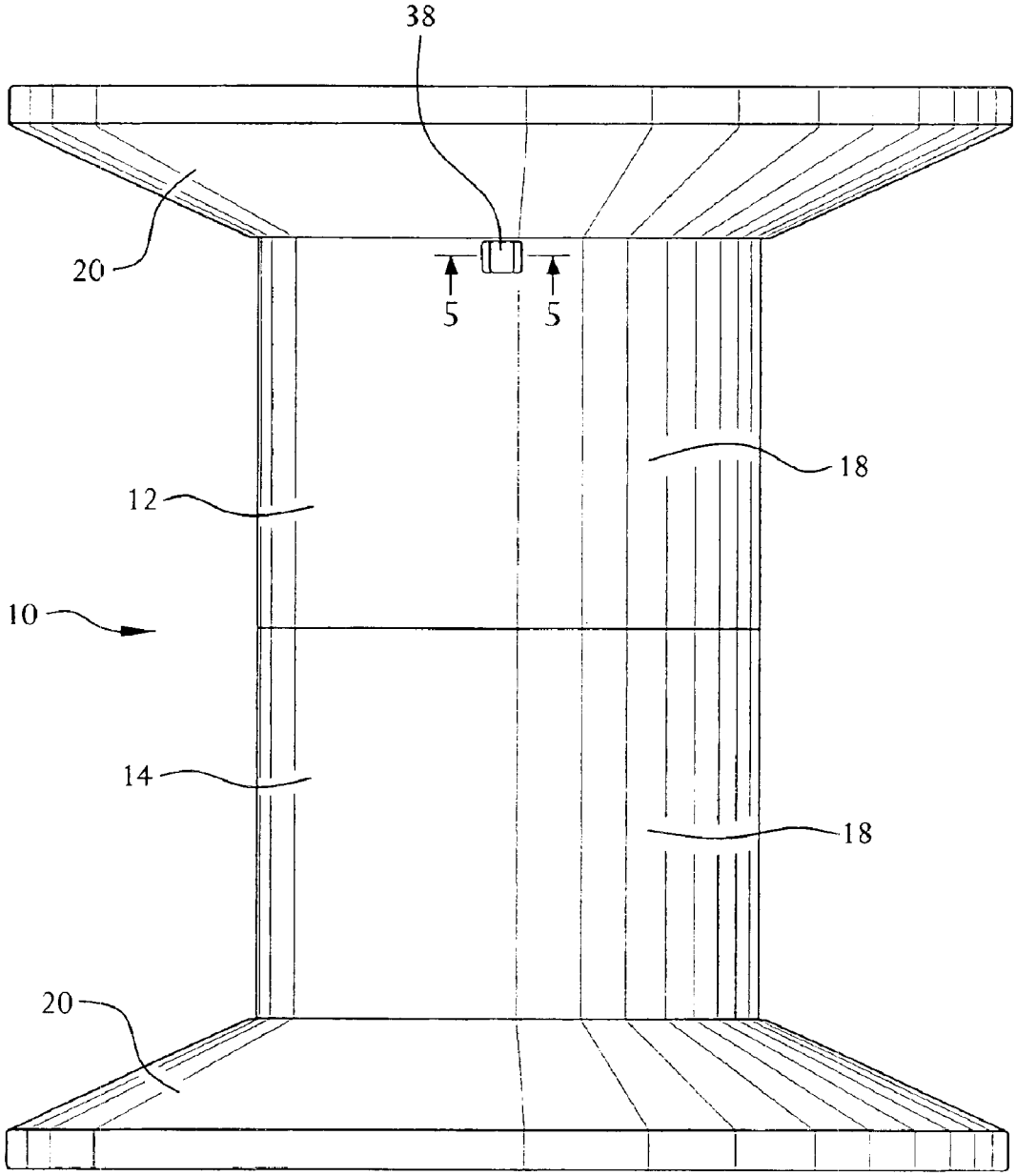
FIG. 1 is a side elevation view of a spool according to the present invention.
Figure 2:
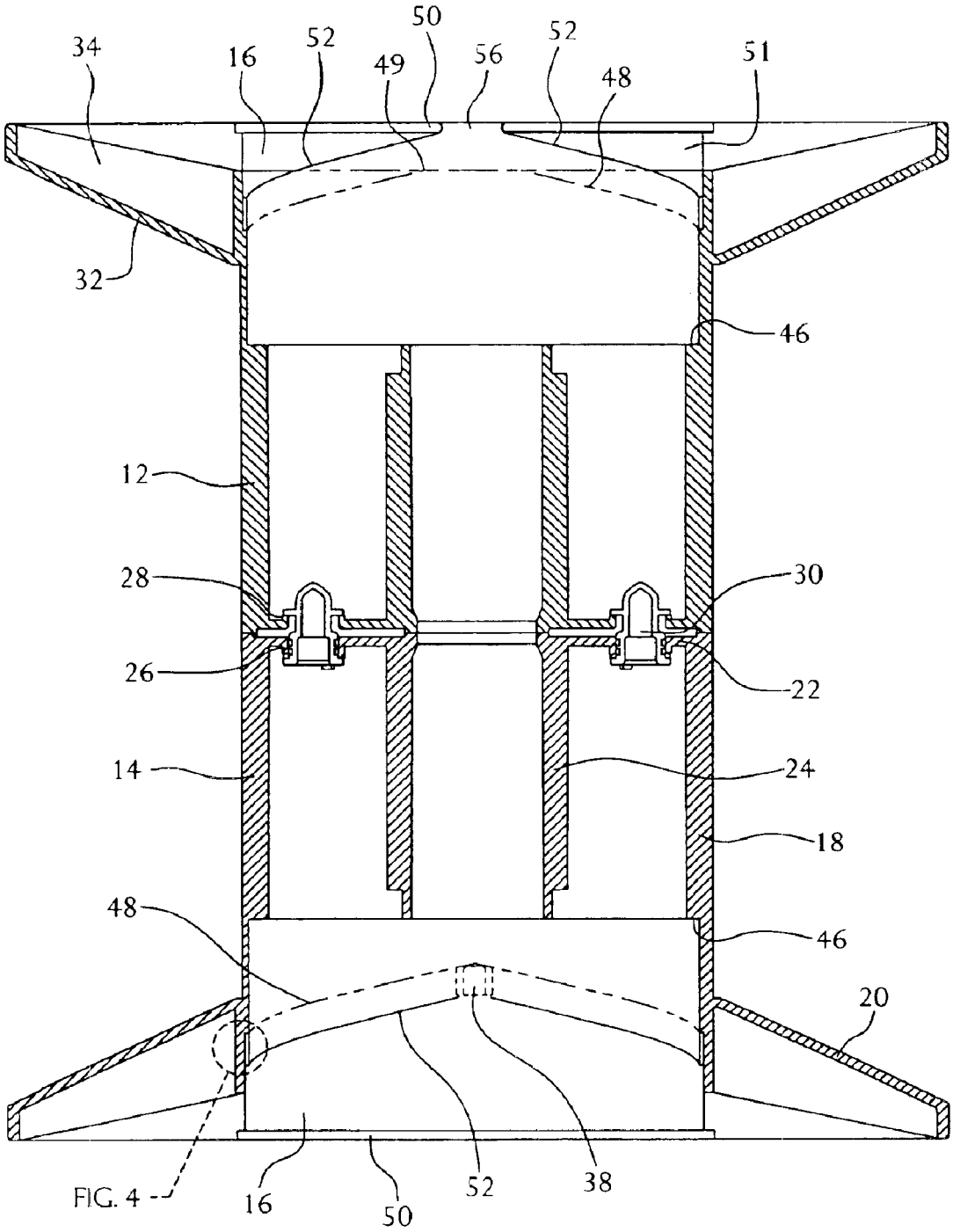
FIG. 2 is an axial section view through the spool of FIG. 1.
Figure 3:
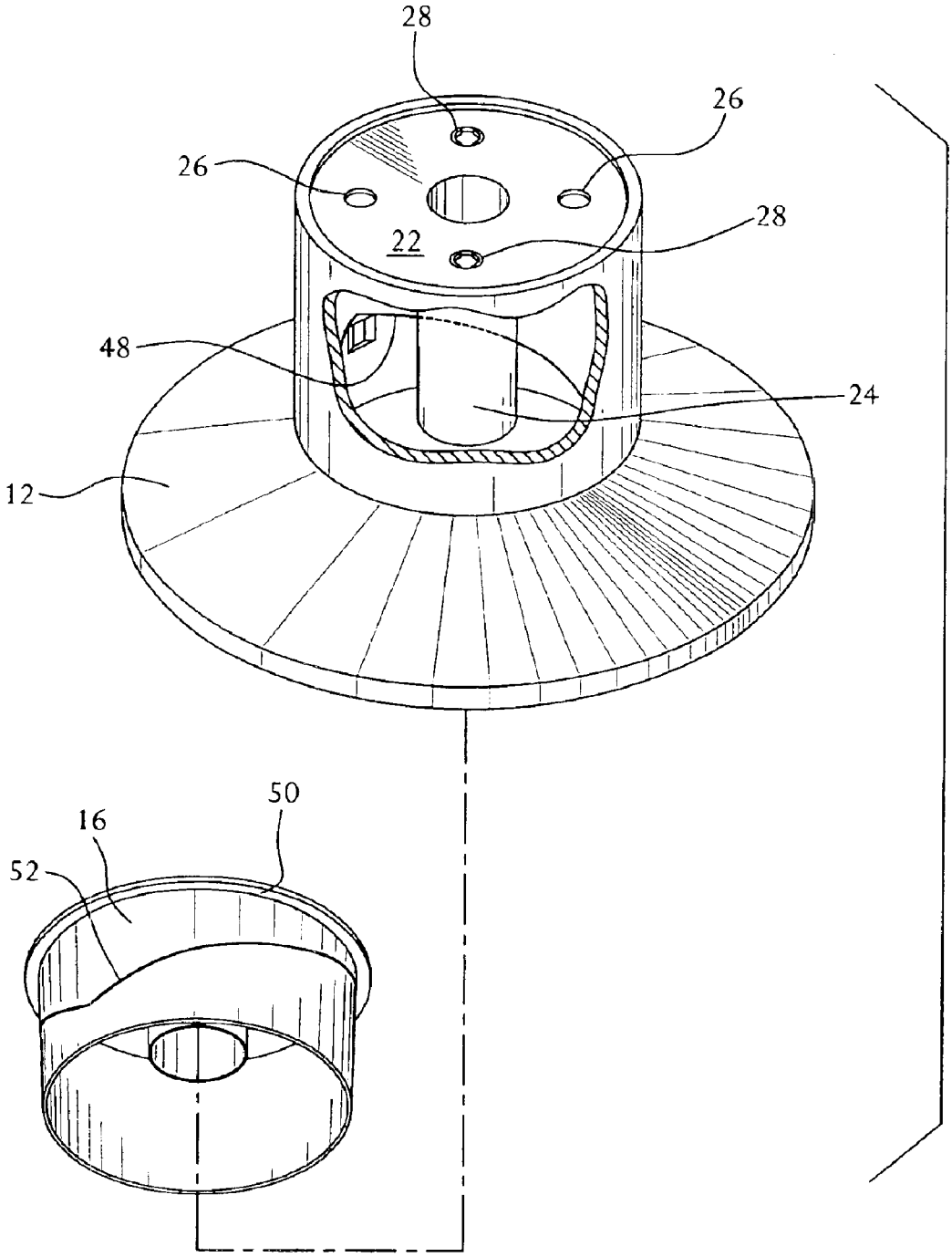
FIG. 3 is an isometric exploded view of a spool half and end insert of the spool of FIG. 1.

Referring to the drawings, and initially to FIGS. 1 to 5, one embodiment of spool, indicated generally by the reference numeral 10, includes two spool halves 12 and 14, and two end inserts 16. Each spool half 12, 14 includes a barrel 18, a radially outwardly-extending main flange 20 at one end, an end wall 22 at an opposite end, and a hollow axial shaft 24.

The end wall 22 of each spool half 12, 14 joins the axial shaft 24 to the barrel 18. Radial ribs or the like may also be provided within a core region of the spool, between the axial shaft 24 and the barrel 18, to provide increased strength and stiffness if desired. As illustrated, the end walls 22 are provided with fittings 26, 28 for quick-release fasteners 30 to join the two spool halves 12, 14 together. Suitable fittings and fasteners are described in more detail in U.S. Pat. No. 5,908,172.

As illustrated, each main flange 20 includes a frusto-conical wall 32 having a smooth face on one side directed into the central region of the spool 10 when the two halves 12, 14 are assembled. Radial stiffening ribs 34 are positioned on the outward side of the flange 20. It should be noted, however, that other forms of flanges and spools may utilize the features of the present invention. For example, the spool may include radially straight flange walls or other stiffening structures than those particularly shown. When the two spool halves 12, 14 are assembled together, the barrels 18 and the smooth walls 32 of the main flanges 20 define an annular region onto which an optical fiber ribbon or other length of thin, flexible material can be wound.

A window 38 is provided through the barrel 18, close to the main flange 20. As may be best seen in FIG. 5, the side walls of the window 38 in the circumferential directions are formed with bevels 40, 42 on both faces. The bevels 40, 42 are angled and aligned so that an optical fiber ribbon 44 may pass from an alignment lying along the outside of the barrel 18 to an alignment lying along the inside of the barrel without any sharp kinks or bends. As may be seen in FIG. 5, the bevels 40, 42 are formed symmetrically on both sides of the window 38, so that a ribbon 44 may enter the window either from left to right or from right to left as seen in FIG.

Figure 5:
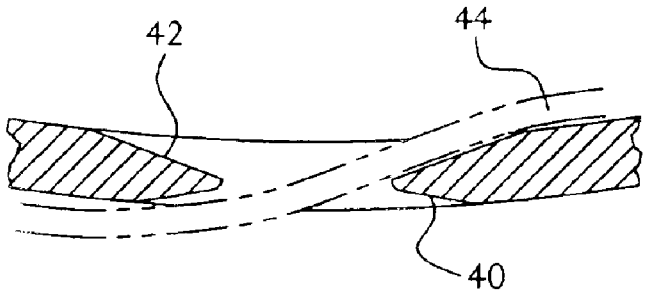
FIG. 5 is an enlarged detail section along the line 5—5 in FIG. 1.

5. The window 38 shown in FIGS. 1 and 5 is dimensioned to receive a flat ribbon, which occupies most of the axial length of the window while lying fairly flat against the bevels 40 and 42. It will be understood that a narrower ribbon could be passed through the window 38, or that the shape of the window could be altered to fit different forms of media.

The inside of the barrel 18 is formed with two steps. A circular step or shoulder 46, facing away from the end wall 22, encircles the barrel between the window 38 and the end wall 22, preferably fairly close to the window. When the spool 10 is assembled, the insert 16 fits within the barrel 18 and seats against the step 46.

A helical step 48, also facing away from the end wall 22, forms a cusp immediately adjacent to the window 38, on the side of the window towards the end wall, and extends from that cusp helically round the barrel in both directions and away from the end wall 22. The ends 49 of the helical step 48 meet the axial end of the barrel 18 almost opposite the window 38. The step 48 is shown in phantom lines in FIG. 2 because, in the interests of clarity, only the parts of the helical step above the plane of section are shown at each end of the barrel 10.

The insert 16 has at its outer end an auxiliary flange 50 which is spaced from the end of the barrel by a distance approximately equal to the axial height of the window 38 when the insert is inserted into the barrel 18 and seated against the shoulder 46. An auxiliary barrel 51 is formed by the portion of the insert 16 between the end of the barrel 18 and the auxiliary flange 50.

When the insert is 16 is received in the barrel 18 and seated on shoulder 46 such that the insert 16 is correctly oriented, the helical step 52 parallels the step 48 of the barrel 18. This positions the cusp of the step 52 immediately adjacent to an end of the window 38 furthest from the end wall 22. The parts of the insert 16 on either side of the step 52 are radiused to fit snugly within the parts of the barrel 18 on their respective sides of the helical step 48.

Figure 4:
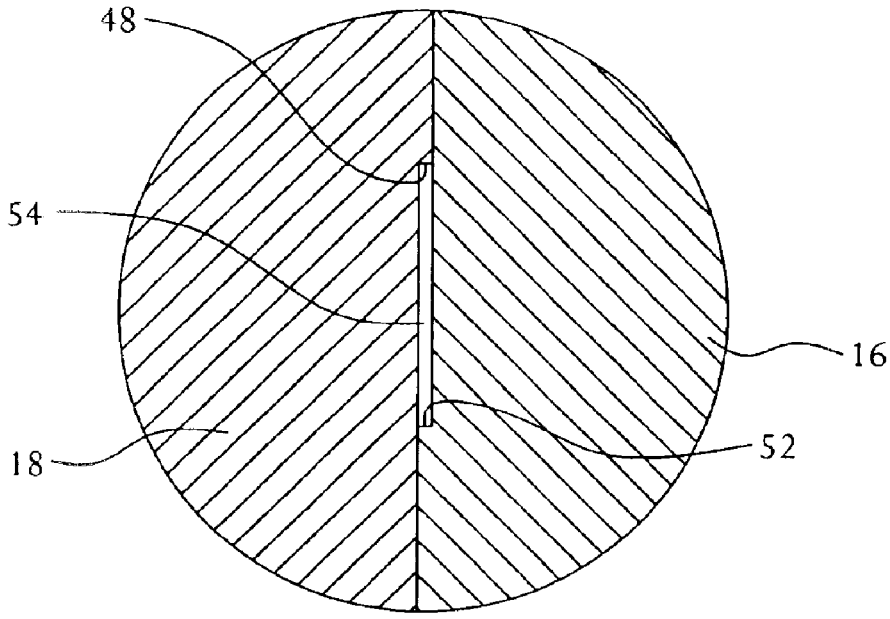
FIG. 4 is an enlarged detail of FIG. 2.

As is shown in FIG. 4, a helical channel 54 is formed between the steps 48 and 52 of the barrel 18 and the insert 16, respectively. The depth of the channel 54 in the radial direction of the spool 10 is set by the height of the steps 48 and 52. The width of the channel in the axial direction of the spool is set by the spacing between the steps 48 and 52, which is approximately equal to the axial length of window 38. The step 52 is gradually reduced in height towards the auxiliary flange 50 such that there is not a substantial step across the area of the auxiliary barrel 51.

In use, the two spool halves 12, 14 are assembled together. The inserts 16 are then inserted into the barrel 18. The inside end of a fiber optic ribbon or other length of flexible media is brought to the outside of the barrel 18, and fed through the window 38 into the channel 54. The ribbon is then pushed further into the window 38 and along the channel 54, until the end of the ribbon emerges into the auxiliary barrel area 51. The ribbon 44 can then be both pushed and pulled until a sufficient length of the ribbon is at the auxiliary barrel area. The free end may then be wound round the auxiliary barrel, between the end of the main barrel 18 and the auxiliary flange 50, and secured with tape, clips, or any other suitable expedient. The free end may be led off the auxiliary barrel 51 through a gap 56 in the auxiliary flange 50, and taped to the end face of the spool. The spool 10, with the inside end of the ribbon 44 effectively secured to the barrel surface where it emerges from the window 38, may then be wound full of ribbon by conventional manual or automated spool winding.

When it is desired to test the ribbon 44, the inside end can easily be freed from the auxiliary barrel 51, and the outside end is exposed and accessible on the surface of the windings. The two ends can thus easily be connected to test equipment. Because of the arrangement of the window 38 and the helical guide channel 54, there are no kinks or sharp bends in the ribbon that might stress the optical fiber or otherwise interfere with optical transmission along the fiber, and that might thus erroneously be detected as faults or flaws in the ribbon.

It will be seen that each of the spool halves 12, 14 and the inserts 16 may be made from a plastic material in a single operation using a two-piece mold parting in the axial direction. Only small, simple mold inserts are needed for the window 38. The spool 10 is thus very economical to manufacture. It will be understood by those skilled in the art that, for reasons of practicality in molding, the cylindrical parts of the spool may in fact need to be slightly tapered. However, the necessary taper need not interfere with the function of the spool.

Figure 6:
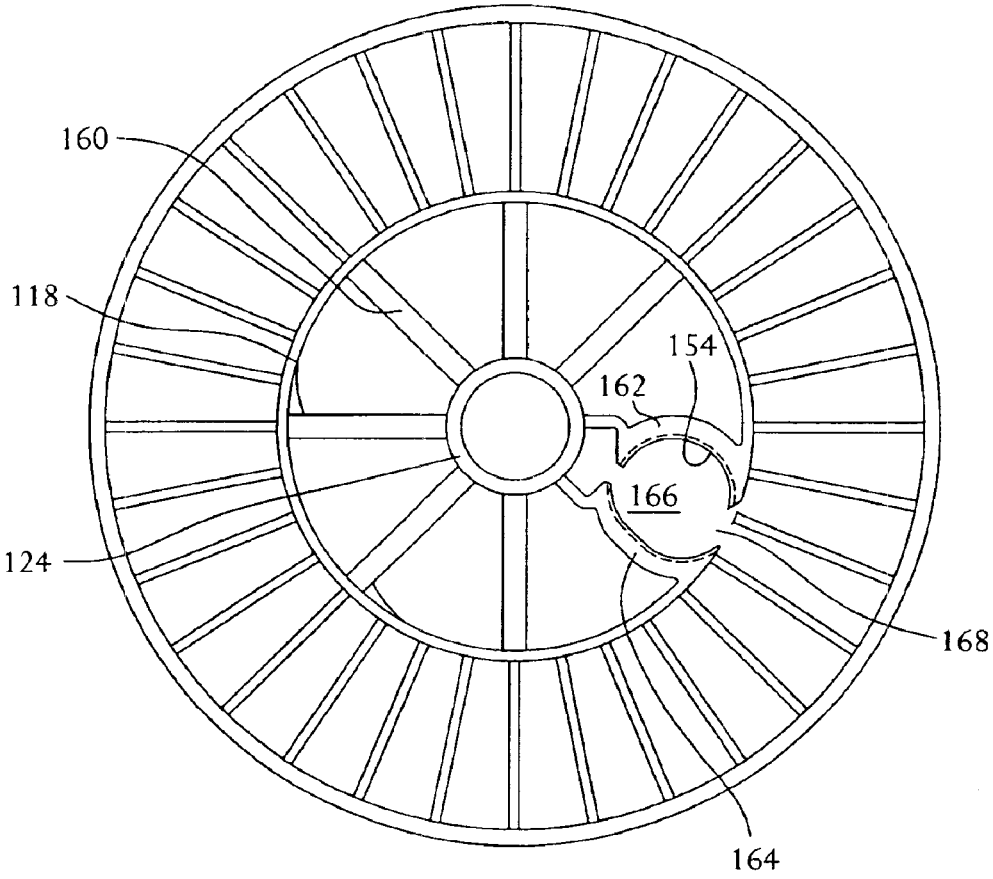
FIG. 6 is an end elevation view of a spool according to a second embodiment of the invention.
Figure 7:
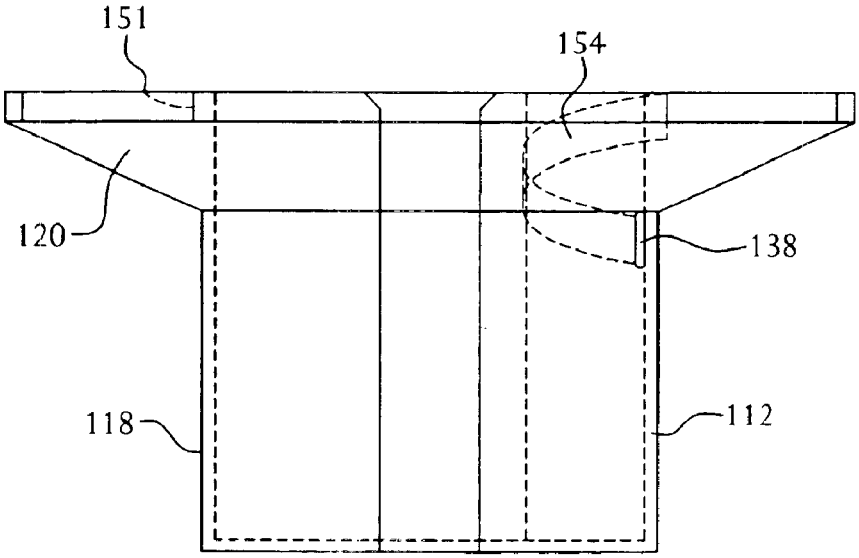
FIG. 7 is a side elevation view of one of the spool halves of the spool of FIG. 6.

FIGS. 6 and 7 show a second embodiment of the invention. In FIGS. 6 and 7 features that are the same as or equivalent to those shown in FIGS. 1 to 5 are given reference numerals greater by 100 than those used in FIGS. 1 to 5. In the interests of simplicity, only one spool half 112 is shown in FIG. 7. It will be understood that to form a complete spool two spool halves 112 are to be joined together with connectors that may be similar to the connectors 26, 28, 30 shown in FIG. 2.

In the second embodiment, a spool half 112 does not include a separate insert, although such may be utilized if desired. Radial ribs 160 join an axial shaft 124 to the inside of a barrel 118 over the entire axial length of the barrel. The barrel 118 extends beyond a main flange 120 to form an auxiliary barrel surface 151. Between two of the ribs 162, 164 is formed a cylindrical space 166. A window 138 opens through the barrel 118 into the cylindrical space 166. A gap 168 opens through the auxiliary barrel surface 151 into the cylindrical space.

A helical channel 154, formed in the ribs 162, 164 leads round the cylindrical space 166 from the window 138 to the gap 168. The helical channel 154 is not closed on the side towards the space 166, but is formed as a wide, shallow groove in the surfaces of the ribs 162, 164. This arrangement is believed to be satisfactory provided that the ribbon 44 or other medium being loaded onto the spool is sufficiently stiff and springy that it will press itself into the groove 154 by its natural tendency to straighten out. Alternatively, a cylindrical plug could be inserted into the space 166 to prevent the ribbon 44 from coming out of the groove 154.

It will be appreciated that the spool half 112, because of the groove 154, cannot be molded with a simple two-part mold. However, the groove 154 can easily be formed by a collapsible mold insert. Indeed, if the groove 154 is a perfect cylindrical helix, the groove 154 could be formed by a rigid insert with a helical ridge to form the groove. The mold insert could then be removed by unscrewing it along the groove 154. Thus, this form of spool is also simple and economical to manufacture.

Although the spool 10 shown in FIGS. 1 to 5 has a guide channel 54 formed between steps in two components, and the a variant of the spool shown in FIGS. 6 and 7 has been described with a guide channel formed between a grooved component and a plain cylindrical one, those approaches could, of course, be interchanged.

Figure 8:
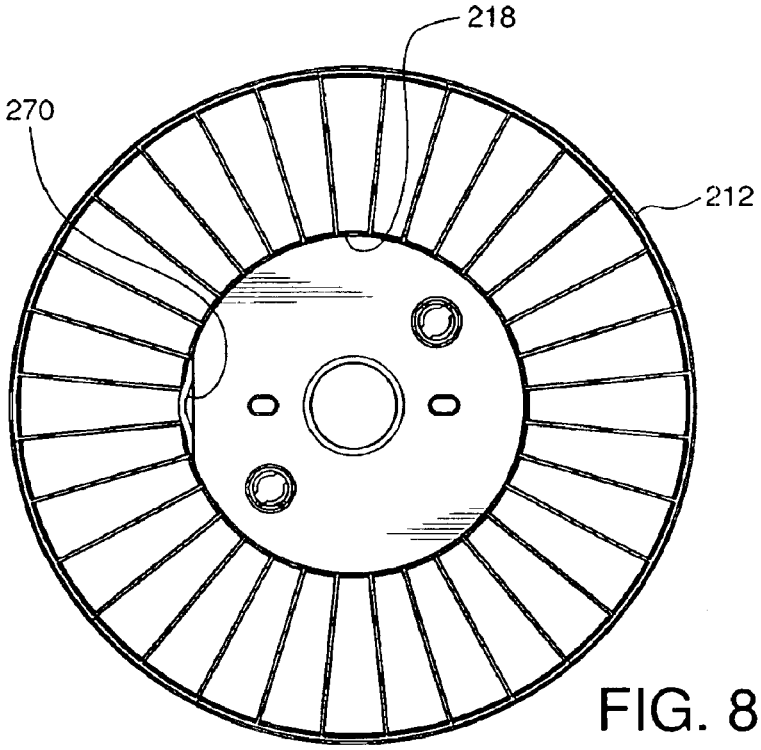
FIG. 8 is an end elevation view of a spool having an insert orienting construction, the spool shown with the insert removed.
Figure 9:
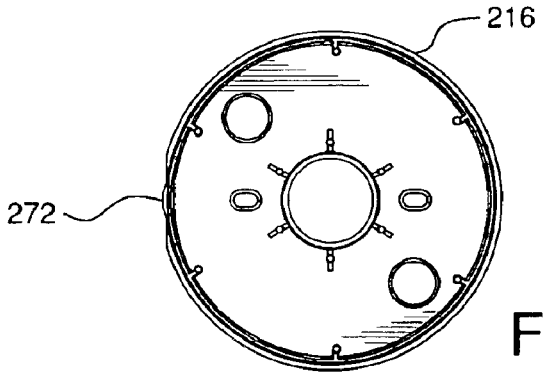
FIG. 9 is an end elevation view of an insert adapted for receipt within an end of the spool of FIG. 8.
Figure 10:
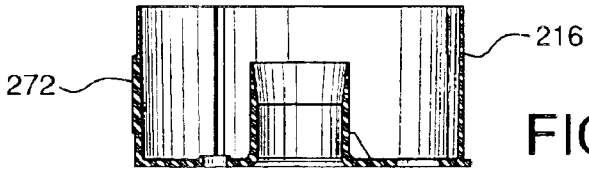
FIG. 10 is an axial section view through the insert of FIG. 9.

Referring to FIGS. 8–10, there is shown a spool half 212 and an insert 216 for a spool according to the invention having a construction that ensures that the insert 216 will be received by the spool half 212 in a particular orientation. Such orienting of the insert 216 is desirable, for example, in spools such as spool 10 of FIGS. 1–5 where formation of the helical guide channel requires proper orientation of the insert 16 with respect to the spool half. As shown in FIG. 8, the barrel 218 of the spool half 212 includes a groove 270. The groove 270 is adapted to receive a correspondingly formed projection 272 on an outer surface of the insert 216 when the insert is received by the spool half 212 in the proper orientation. When the orienting construction shown in FIGS. 8–10 is incorporated into a spool such as spool 10 of FIGS. 1–5, the projection 272 would preferably be aligned with the gap 56 in the auxiliary flange 50. Also, the groove 272 would preferably be aligned with the bevels 40 for window 38. Such positioning of the projection 270 and groove 272 simplifies the mold design.

The embodiments have been described primarily with reference to optical fiber ribbon as the material to be wound onto the spools. It will be understood that the spools could be used for other materials. The material is preferably sufficiently smooth and stiff to permit it to be pushed along the guide channel 54 without jamming and sufficiently stiff to remain in the open guide channel 154. The spool of the present invention is not usually called for unless access is needed to both ends of the material wound on the spool, and sharp bends or kinks in the material are to be avoided. If the material is not ribbon shaped, then appropriate adjustments should be made to the shapes of the window 38 and the guide channel 54 or 154.

Although embodiments have been described as being assembled from two identical spool halves 12 and 14 or 112, the spool could be formed in one piece, or assembled in some other way. If the spool is assembled from two spool halves, the two spool halves need not be identical. A guide channel 54 or 154 could be provided at only one end of the spool, or different forms of guide channel could be provided at the two ends. For most purposes, however, it is believed that an arrangement with identical guide channels at both ends, each capable of receiving a lead in end wrapped round the spool in either direction, is preferable. This arrangement may be less versatile than one with different guide channels and may be slightly more expensive than one with a guide channel at only one end. However, the arrangement will be usually be easier to use because an operator does not need to spend time identifying the end with the desired guide channel, or worrying about whether that guide channel is left- or right-handed.

What is claimed is:

1. A device for winding an elongated material, the device comprising:

a barrel having an outer surface and a central axis;

at least one flange wall, the outer surface of the barrel and the at least one flange wall defining an exterior space for winding an elongated material, one of the barrel and the at least one flange wall defining an interior and an opening, the opening communicating with the interior and with the exterior space for passage of an end portion of the elongated material therebetween; and a material guide having a first end located within the interior adjacent the opening and an opposite second end, the material guide adapted to receive an end portion of the elongated material from the exterior space through the opening and to direct the elongated material along a pathway, at least a portion of the material guide being continuous and defining a helix along the barrel central axis.

2. The winding device according to claim 1, wherein the barrel defines the interior of the device and the opening.

3. The winding device according to claim 1, further comprising an auxiliary winding surface adjacent the second end of the material guide, the auxiliary winding surface adapted for winding receipt of the end portion of the elongated material directed to the auxiliary winding surface by the material guide.

4. The winding device according to claim 2, wherein the barrel includes an open end having an inner surface defining the interior and wherein the winding device further comprises an insert having opposite first and second ends and an outer surface slidingly received by the open end of the barrel, the material guide being defined between the inner surface of the barrel and the outer surface of the insert.

5. The winding device according to claim 4, wherein the material guide includes opposite end walls extending substantially continuously between the first and second ends of the material guide and wherein each of the barrel inner surface and the insert outer surface includes a recessed portion defining a step, the steps of the barrel and the insert each forming one of the opposite ends of the material guide.

6. The winding device according to claim 5, wherein the recessed portion of the barrel defines a second step located longitudinally inwardly from the first step, the second step defining an annular shoulder for contact with the first end of the insert.

7. The winding device according to claim 6, wherein the second end of the insert extends outwardly from the open end of the barrel such that a portion of the insert outer surface adjacent the second end of the insert defines an auxiliary winding surface for receiving the end portion of the elongated material from the material guide.

8. The winding device according to claim 1 wherein the device comprises a pair of flanges, the device further comprising two half portions secured together, each of the half portions of the device including a portion of the barrel and one of the flanges.

9. The winding device according to claim 1, wherein the opening communicating with the interior includes opposite ends and wherein the device comprises a pair of material guides each having a first end located adjacent one of the opposite ends and extending oppositely from the other of the material guides.

10. The winding device according to claim 9, wherein opposite ends of the opening are beveled.

11. The winding device according to claim 4, wherein the inner surface of the barrel and the outer surface of the insert are substantially cylindrical and wherein at least one portion of each of the insert outer surface and the barrel inner surface defines a non-cylindrical surface, the non-cylindrical surfaces of the insert and the barrel adapted for interfit with each other for orienting the insert with respect to the barrel.

12. The winding device according to claim 11, wherein the non-cylindrical surface of the insert outer surface includes at least one projection adapted for interfit within a correspondingly formed groove defined by the non-cylindrical surface of the barrel inner surface.

13. A spool comprising:

a barrel having a wall defining opposite inner and outer surfaces;

a pair of flanges secured to the barrel to define a winding space between the flanges, the wall of the barrel including an opening communicating with the winding space; and an insert having an outer surface adapted for sliding receipt by the inner surface of the barrel, the barrel and the insert defining an elongated guide channel between the surfaces of the barrel and the insert having opposite first and second ends, a continuous portion of the guide channel being substantially helical and the guide channel advancing axially with respect to the barrel between the first and second ends of the guide channel, the first end of the guide channel located adjacent the opening in the barrel wall.

14. The spool according to 13, wherein at least a portion of one of the flanges is located between the first and second end of the guide channel.

15. The spool according to 13, wherein one of the barrel and the insert defines an auxiliary winding surface adjacent the second end of the guide channel.

16. The spool according to 15, wherein the auxiliary winding surface is defined by a portion of the insert extending beyond an end of the barrel.

17. A spool for winding an elongated material, the spool comprising:

a barrel defining a longitudinal axis and having an outer surface;

a pair of flanges defining with the outer surface of the barrel an exterior space for winding an elongated material, the barrel defining an interior and including an opening communicating with the exterior space and the interior; and an elongated guide channel having a first end located within the interior adjacent the opening and an opposite second end, the guide channel adapted to receive a portion of the elongated material from the exterior space through the opening in the barrel and guide the elongated material between the first and second ends of the guide channel, a continuous portion of the guide channel being substantially helical, the first and second ends of the guide channel located at different longitudinal locations along the barrel, and at least a portion of one of the flanges located between the first and second ends of the guide channel.

18. A spool comprising:

a barrel having an outer surface defining a primary winding area for winding receipt of an elongated material and a central axis;

a secondary winding area for winding receipt of an end portion of the elongated material; and a material guide at least partially located within an interior defined by the spool and having a first end located adjacent the primary winding area and an opposite second end located adjacent the secondary winding area, the material guide defining an elongated passage for receiving the end portion of an elongated material from the primary winding area and guiding the end portion to the secondary winding are, a continuous portion of the material guide being substantially helical, the first and second ends of the material guide being axially offset from each other with respect to the barrel central axis.

* * * * *